United States Patent [19]

O'Hagan

[11] 4,200,490

[45] Apr. 29, 1980

[54] METHOD AND APPARATUS FOR HANDLING ROLLS INSIDE AN ENDLESS PAPER-MAKING BELT

[75] Inventor: Peter K. O'Hagan, Westmount, Canada

[73] Assignee: Scapa Canada Ltee, St. Laurent, Canada

[21] Appl. No.: 927,480

[22] Filed: Jul. 24, 1978

[30] Foreign Application Priority Data

Jul. 21, 1978 [CA] Canada ..... 307888

[51] Int. Cl.[2] ..... D21F 1/26

[52] U.S. Cl. ..... 162/200; 162/273; 74/242.13 R; 414/676

[58] Field of Search ..... 162/200, 273; 214/1 BE, 214/DIG. 4; 193/42; 254/52; 26/99; 74/242.13 R

[56] References Cited

U.S. PATENT DOCUMENTS

| | | | |
|---|---|---|---|
| Re. 25,045 | 10/1961 | Petersen et al. | 214/1 BE |
| 1,851,941 | 3/1932 | Broadhurst | 162/273 |
| 2,299,746 | 10/1942 | Hart | 162/273 |
| 2,550,192 | 4/1951 | Hart | 162/273 |
| 3,025,909 | 3/1962 | Hart | 162/273 |
| 3,129,135 | 4/1964 | Hornbostel et al. | 162/273 |
| 3,140,223 | 7/1964 | Truxa | 162/273 |
| 3,843,469 | 10/1974 | Naumanen | 162/273 |
| 3,923,165 | 12/1975 | Burdick | 214/1 BE |

FOREIGN PATENT DOCUMENTS

| | | |
|---|---|---|
| 1147098 | 4/1969 | United Kingdom . |
| 1158541 | 7/1969 | United Kingdom . |
| 1174490 | 12/1969 | United Kingdom . |
| 1201761 | 8/1970 | United Kingdom . |
| 1352575 | 5/1974 | United Kingdom . |
| 1353585 | 5/1974 | United Kingdom . |
| 1379998 | 1/1975 | United Kingdom . |
| 1424519 | 2/1976 | United Kingdom . |

OTHER PUBLICATIONS

Cuneo et al., "Method of and Apparatus for Providing a Gas Bearing . . ." Western Electric Technical Digest No. 26, Apr. 1972, pp. 23–24.

*Primary Examiner*—Richard V. Fisher

*Attorney, Agent, or Firm*—Fleit & Jacobson

[57] ABSTRACT

A support device with air caster units is provided sufficient to lift and support heavy rollers or rolls inside an endless belt so that the rolls can be removed from within the endless belt and the endless belt replaced.

18 Claims, 9 Drawing Figures

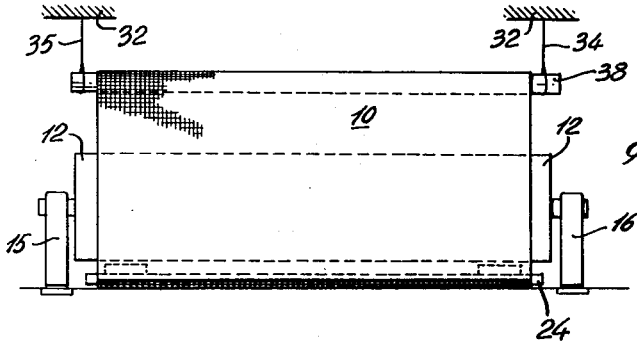
Fig. 4
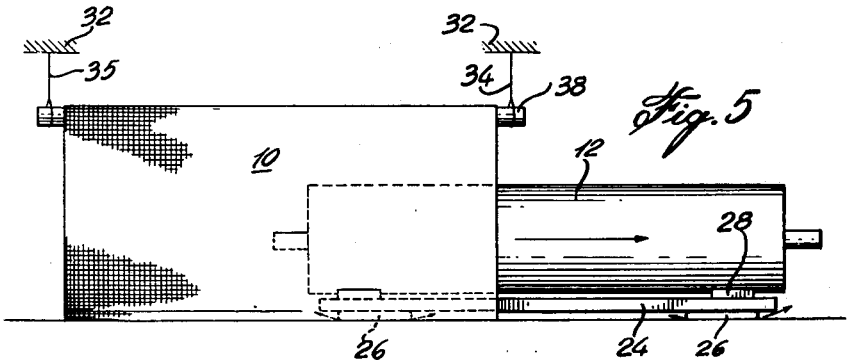
Fig. 5
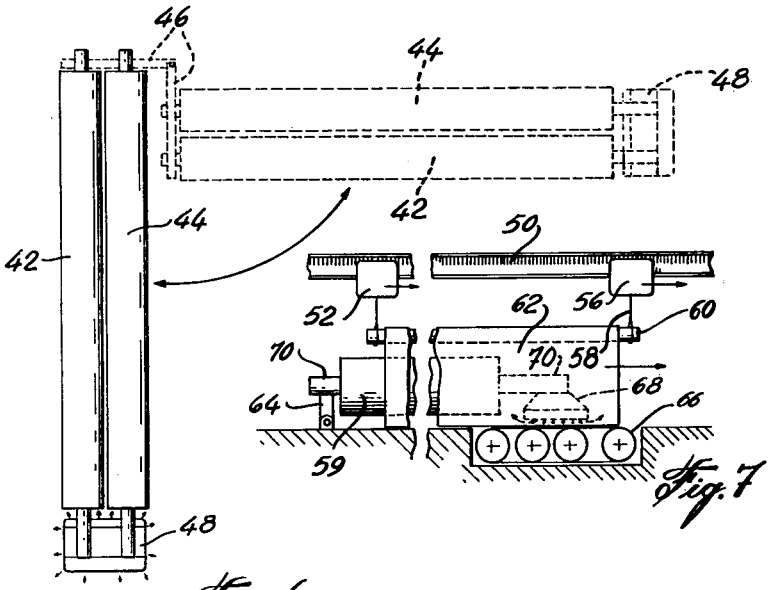
Fig. 7
Fig. 6

74
90
89
10
96
94
83b
85
76
78
9
83a 14
82b
85
78
87
78
76
82a
88
80b
10
86
84
12
76
78
78
80a

METHOD AND APPARATUS FOR HANDLING ROLLS INSIDE AN ENDLESS PAPER-MAKING BELT

BACKGROUND OF THE INVENTION

1. Field of the Invention

The present invention relates to the method and apparatus for handling endless paper-making belts, and more particularly, to a device for installing or removing an endless paper-making belt from around heavy rolls.

2. Description of the Prior Art

The handling of large endless belts, especially in the light of their breadth, provides difficulties when installing such endless belts around heavy rolls such as those found in the forming section of a paper-making machine or the stretcher rolls used in the manufacture of paper-making belts. On paper machines these belts are called wires, fabric or felts. On conventional paper-making machines, when changing the forming fabric, the old fabric on the machine is suspended while the breast and couch rolls are held in a cantilever manner while the various other suction rolls and foils and suction boxes are also held in a cantilever manner. Tension is released on the fabric, and the fabric is removed from the free end of the rolls.

In the case of the stretching rolls used in the manufacture of these fabrics, the rolls are moved towards each other on bearing supports mounted on wheels travelling in tracks provided in the floor thereof. As the tension in the fabric is released, the fabric is held tent-like and the rolls are moved inwardly to the point where they are cantilevered so that the fabric can be removed over the end of the rolls and the new fabric replaced. The weight of the stretching rolls used in the manufacture of the fabric or the weight of the breast and couch rolls on a paper machine are such that a considerable support structure must be provided on the cantilevered side so as to support the full length of these rolls while the fabric is being removed and replaced. This problem is especially acute in the manufacture of paper-making belts since these belts are continuously being installed or removed from the stretcher rolls during their production. Accordingly, in the building in which the belts are being stretched, the floor must often be especially reinforced on the support side of the rolls in order to properly cantilever the stretching rolls which might sometimes exceed 40 feet.

SUMMARY OF THE INVENTION

It is an aim of the present invention to provide an apparatus and a method for overcoming certain problems in the handling of large endless belts, especially when they are installed on or removed from around heavy stretching rolls in the manufacture thereof or from paper-making machines. These rolls may be in excess of 40 ft. in width and 4 ft. in diameter.

An apparatus in accordance with the present invention includes a roll support platform including air supported casters mounted to the bottom of said platform adapted for lifting and gliding the platform and the supported roll over the belt such that the rolls can be completely removed from within the endless belt to allow the belt to be changed.

A method in accordance with the present invention includes the steps of changing an endless paper-making belt, including first releasing the tension on the belt, supporting the end rolls on air casters such that the rolls and support means are spaced from the floor and moving the supported rolls from within the belt clear of the belt so as to effect its change.

In a more specific embodiment of the present apparatus in accordance with the invention, the support platform includes an endless web adapted to pass under the air supported casters such that the endless web is in contact with the fabric as the support platform moves over the fabric, the endless web passing over the platform as the platform supporting the roll is moved.

BRIEF DESCRIPTION OF THE DRAWINGS

Having thus generally described the nature of the invention, reference will now be made to the accompanying drawings, showing by way of illustration, preferred embodiments thereof, and in which:

FIG. 4 is an end elevation of the rollers shown as they would appear in FIG. 3;

FIG. 5 is an end elevation similar to FIG. 4 showing the stretching rolls mounted on the air-caster-support platforms and being moved clear of the fabric;

FIG. 6 is a top plan view of a different embodiment of a method of moving the rolls from within the fabric using the air-caster-support platform;

FIG. 7 is a fragmentary view, partly in cross-section, showing a still further manner of removing the wire from the rolls using an air-caster-support platform;

DESCRIPTION OF THE PREFERRED EMBODIMENTS

Figure 1:
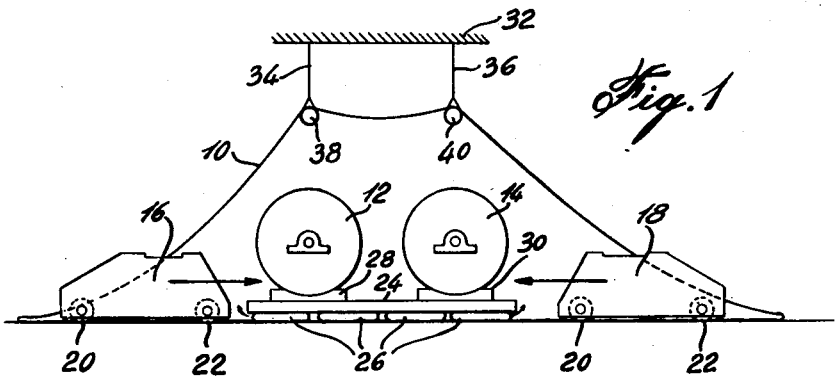
FIG. 1 is a schematic view showing the fabric in side elevation with the rolls on an air-caster-support platform.
Figure 2:
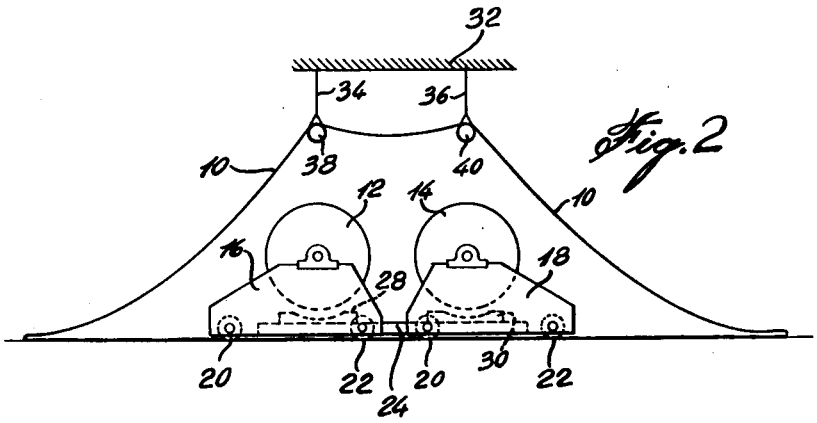
FIG. 2 is a schematic elevational view similar to FIG. 1 showing the rolls supported on the bearing supports rolling in the tracks.
Figure 3:
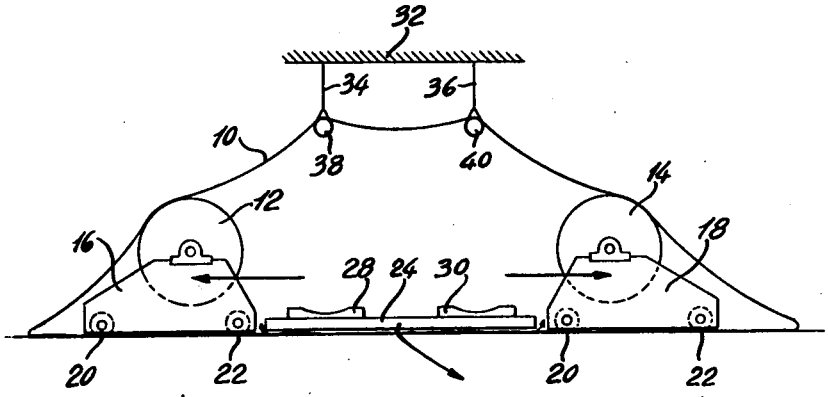
FIG. 3 is a schematic side elevation similar to FIGS. 1 and 2 showing the rolls being moved outwardly within the fabric on the bearing supports.

Referring now to FIGS. 1 through 5, there is shown a pair of stretcher rollers 12 and 14 and a belt 10. The belt 10 is endless and is in the process of being finished for use. The rolls 12 and 14 are normally mounted on bearing supports 16 and 18 which in turn have wheels 20 and 22 for movement in tracks embedded in the floor. In a normal stretching process, the rolls 12 and 14 are moved away from each other, stretching the fabric about the rolls 12 and 14. After this has been accomplished, the bearing supports 16 and 18 are moved inwardly towards each other, as shown in FIG. 2, and are allowed to position the rolls 12 and 14 over pillows 28 and 30 of a transporter including a platform 24.

The belt 10 can be hung by means of hangers 34 and 36 suspended from the ceiling 32 and supporting poles 38 and 40 which in turn hang the belt 10 as a tent so as to allow clear movement of the rolls 12 and 14.

The platform 24 is provided underneath and at each end thereof with so-called air casters 26. The air caster 26 includes a square steel plate or frame and a circular rubber curtain or annular diaphragm extending from the plate and air under pressure is fed into the space defined by the rubber skirt. Air eventually escapes between the skirt and the ground, but the air pressure contained within the annular skirt allows any air caster to be lifted and held off the ground even when supporting a great load. A typical air caster is supplied by Aero-Go Inc. under the trade mark "AERO CASTER". It is contemplated that a cluster of air casters 26 would be supplied at each end of the platform 24, and the air casters as well as the platform 24 would be effective to lift the rolls 12 and 14 off of the bearing supports 16 and 18, and very little force would be required to move the otherwise heavy rolls 12 and 14 on the transporter clear of the belt 10, as shown in FIGS. 4 and 5.

Because the transporter 24 is supported on air over the floor and no portion of the transporter 24 is in contact with the belt 10, the rolls can thus be moved over the belt 10 without apparent damage to the belt 10. Accordingly, rather than having to provide excessively strong floor supports for cantilevering the rolls 12 and 14, they are merely positioned on the transporter 24 and moved out from within the belt 10, and the belt 10 can then be replaced by a new belt to be stretched. It is contemplated that similar versions could be used for changing the paper-making belts found on paper-making machines.

The remaining Figures show the different embodiments using the principle of an air caster for moving the rolls clear of the belt 10. For instance, in FIG. 6, where space might be limited, the rolls 42 and 44 are supported at one end and bearings mounted on a pivoting support 46 are adapted to pivot about a vertical axis. When the rolls 42 and 44 are brought together, the other ends of the shafts of the rolls 42 and 44 are supported on a transporter platform 48 also provided with air casters. The rolls 42 and 44 would then be moved by pivoting about the vertical axis into a position shown in dotted lines. The belt could then be easily cleared of the rolls 42 and 44.

The embodiment in FIG. 7 illustrates how the belt 10 can be moved clear of the rolls 59 rather than moving the rolls clear of the belt 10. In this case, the bearing support 64 is pivoted about a horizontal axis while the other end of the shaft 70 is supported on an air caster transporter. As air pressure is provided within the air casters 68, the transporter lifts off the surface of the ground, and in this case, off a moving metallic slat conveyor 66. Carriages 52 and 56, which move on guide rail 50, support the poles 60 by means of hangers 47 and 58, and the fabric is moved clear of the rolls by passing through the air space underneath the platform 68. In order not to damage the fabric, the conveyor 66 is provided so as to reduce the friction of the fabric as it passes underneath the air transporter platform 68.

Figures 8, 9:
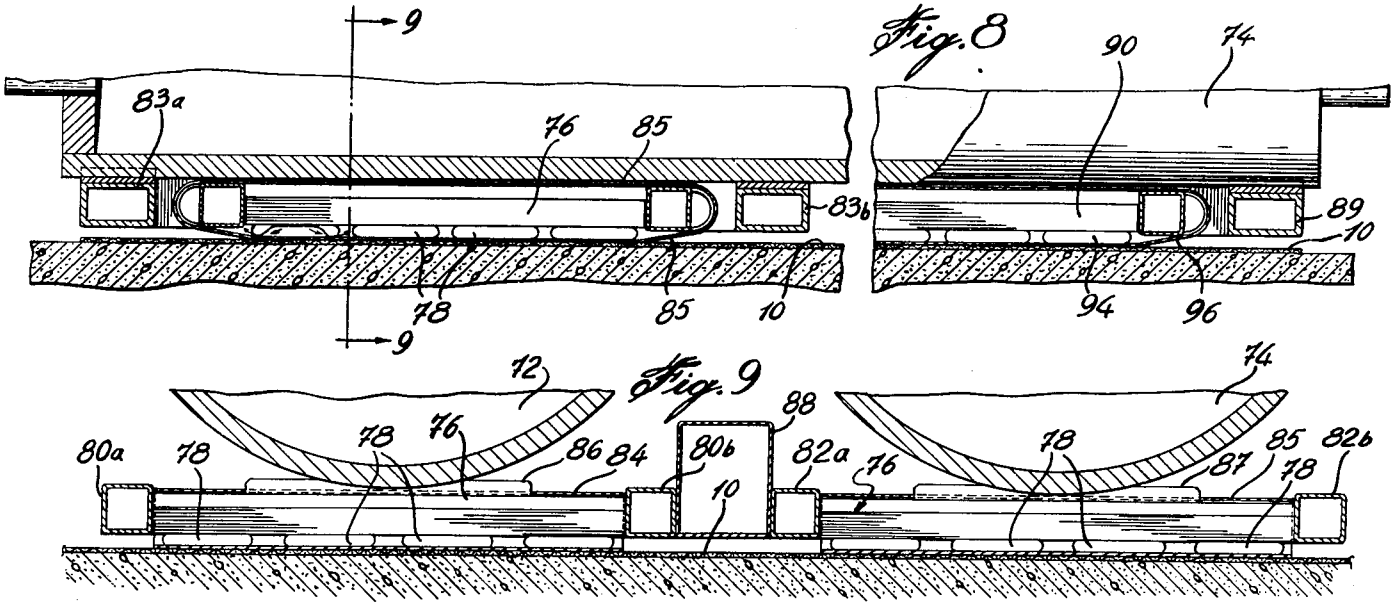
FIG. 8 is an enlarged fragmentary detailed view of a still further embodiment of the air support casters with a roll support platform.
FIG. 9 is a fragmentary vertical cross-section taken along lines 9—9 of FIG. 8.

In the embodiment shown in FIGS. 8 and 9, there is shown a pair of air caster transporters 76 and 90 with one transporter at each end of the rolls 72 and 74. Rolls 72 and 74 are supported at one end on respective pillows 86 and 87, each supported by transporter 76. The transporter 76 includes a platform and beams 80*a* and 80*b*, beams 82*a* and 82*b*, as well as cross-beams 83*a* and 83*b*. Underneath the transporter 76 is a cluster of air casters. An endless web 85 passes about the air casters 78, as shown in FIGS. 8 and 9, such that the pressure of the air in the casters acts on the inner side of the bottom run of the endless web 85 which is trained about the platform. The endless web should have a soft outer surface and a vinyl-like interior surface. The soft outer surface would reduce the possibility of damage to the fabric. As the transporter 76 carrying one end of the roll moves the endless web which is in contact with the fabric or the ground, it is forced to move such that the air casters are always over a static portion of the web 85 relative to the belt. The fragmented end of FIG. 8 shows the other transporter 90 including beams 89 and an endless web 96 with air casters 94 supported on the transporter 90. Of course, the features of the transporter are identical.

Referring to FIG. 9, the transporter 76 is, of course, double such that end beam 88 can connect segments of the transporter 76 and the respective endless web are shown at 84 and 85 while the casters are identified in both groups by the numeral 78.

I claim:

1. An apparatus for enabling the installation and replacement of endless paper-making belts over rolls, including at least one roll support platform, the roll support platform being equipped with air casters sufficient, when operative, to lift the rolls completely off the floor, and means for removing the belt by moving the rolls from within the belt or pulling the belt from the rolls by slipping the bottom run of the belt from between the floor and the air casters.

2. An apparatus as defined in claim 1, wherein the platform includes a roll receiving pillow and a plurality of individual air casters provided underneath the platform for supporting the platform and the roll above the floor such as to allow the platform to pass over the bottom run of the belt without physically contacting the belt.

3. An apparatus as defined in claim 1, wherein separate platforms are provided at each end of the roll and a plurality of individual air caster units are provided underneath each platform.

4. An apparatus as defined in claim 1, wherein a bearing support adapted to pivot about a vertical axis is provided to support the rolls at one end thereof and a support member provided with air caster means is provided to support the rolls at the other end thereof such that the rolls and the air caster means can be glided over the bottom run of the belt in an arc to remove the rolls from within the endless belt.

5. An apparatus as defined in claim 1, wherein bearing support means are provided for pivoting movement about a horizontal axis at one end of the rolls, the at least one roll support platform including a support member with air casters provided at the other end of the rolls, and a conveyor means located beneath the support member for moving the belt relative to the rolls, but static relative to the conveyor means, past the support member with air casters.

6. An apparatus as defined in claim 1, wherein the apparatus further comprises:

bearing support means for supporting first ends of the rolls, the bearing support means being movable about a horizontal axis;

the roll support platform equipped with air casters being associated with other ends of the rolls and being operative to lift the other ends thereby moving the bearing support about its horizontal axis; and the means for removing the belt including means for supporting and horizontally moving the belt so that the bottom run of the belt passes between the floor and the air casters.

7. An apparatus as defined in claim 6, further comprising:

conveying means positioned between the floor and the air casters for reducing frictional forces between the floor and the belt as the belt passes between the floor and the air casters, said conveying means moving with and supporting the bottom run of the belt.

8. An apparatus as defined in claim 7, wherein said conveying means comprises a metallic slat conveyor.

9. A method for removing heavy rolls from within an endless paper-making belt, including the steps of first releasing the tension on the belt, supporting ends of the rolls on air casters such that the rolls and air casters are spaced from the floor, and moving the supported rolls from within the belt and clear of the belt so as to allow changing of the belt.

10. A method as defined in claim 9, wherein the rolls are stretcher rollers used in the manufacture of an endless belt for stretching the belt, wherein the step of releasing the tension on the belt is accomplished by moving the rolls inwardly, the step of supporting ends of the rolls on air casters permitting gliding the rolls over the bottom run of the endless belt, while preventing physical contact of the air casters with the belt.

11. An apparatus for stretching endless belts, the apparatus comprising:

a pair of parallel rolls;

a pair of support means for supporting ends of said rolls, at least one of said support means being movable towards and away from the other, movement of said one support means away from the other serving to stretch an endless belt placed around said rolls;

hanger means for supporting a stretched belt when said one support means moves towards the other; and means for installing endless belts over said rolls and for removing endless belts from said rolls, including (a) at least one roll support platform having at least one air caster sufficient, when operative, to lift the rolls off said support means and to hold the rolls suspended above a surface supporting the apparatus, and (b) means for installing and for removing the belt from said rolls by causing relative movement between said lifted rolls and the belt so that the bottom run of the belt slips between the supporting surface and the lifted rolls.

12. An apparatus as defined in claim 11, wherein said means for installing and for removing comprises means for moving the rolls into and out of the belt.

13. An apparatus as defined in claim 11, wherein said means for installing and for removing comprises means for moving the belt on to and off of the rolls.

14. In a paper-making machine having an endless belt and a plurality of support and operating means positionable inside of the endless belt, the improvement wherein the paper-making machine further comprises air caster means operative for lifting and supporting at least one of said plurality of support and operating means to permit relative horizontal movement between the endless belt and the at least one support and operating means; and movement means for horizontally moving one of the endless belt and the at least one lifted and supported support and operating means between first and second positions, in the first position the endless belt being located between the air caster means and a surface supporting the machine, in the second position the air caster means and the endless belt being horizontally spaced from each other.

15. An apparatus for transporting and supporting components of paper-making equipment, the apparatus being operative to move components between a first position in which the components are positioned inside an endless fabric belt of the paper-making equipment and a second position in which the component and belt are spaced from each other, the supported component passing over the belt during its movement between the first and second positions, said apparatus comprising:

a platform for supporting a component to be transported;

air caster means including at least one air caster unit positioned underneath said platform for lifting said platform; and an endless web encompassing said platform and said air caster means, said endless web contacting a lower run of the endless belt during movement between the first and second positions.

16. An apparatus according to claim 15, wherein said endless web moves with respect to said platform during movement of the components so that there is substantially no relative movement between said endless web and the lower run of the endless belt.

17. An apparatus according to claim 16, wherein the components being moved are rolls used to support the endless belt, and wherein the apparatus further comprises platforms for supporting each end of the rolls.

18. An apparatus according to claim 16, wherein said endless web has a vinyl-like interior surface that minimizes friction between said platform and said belt and a soft outer surface that reduces the possibility of damage to the endless belt.

* * * * *